US009623452B2

(12) United States Patent
Przyjemski

(10) Patent No.: US 9,623,452 B2
(45) Date of Patent: Apr. 18, 2017

(54) HOSE CLEANING APPARATUS AND METHOD

(71) Applicant: Gregory Alan Przyjemski, Mohnton, PA (US)

(72) Inventor: Andrew Gregory Przyjemski, Mohnton, PA (US)

(73) Assignee: Andrew Gregory Przykemski, Mohnton, PA (US)

( * ) Notice: Subject to any disclaimer, the term of this patent is extended or adjusted under 35 U.S.C. 154(b) by 33 days.

(21) Appl. No.: 13/787,893

(22) Filed: Mar. 7, 2013

(65) Prior Publication Data

US 2013/0239994 A1 Sep. 19, 2013

Related U.S. Application Data

(60) Provisional application No. 61/610,420, filed on Mar. 13, 2012.

(51) Int. Cl.
*B08B 9/032* (2006.01)

(52) U.S. Cl.
CPC ..... *B08B 9/0321* (2013.01)

(58) Field of Classification Search
CPC ..... B08B 9/0321
See application file for complete search history.

(56) References Cited

U.S. PATENT DOCUMENTS

| | | | | |
|---|---|---|---|---|
| 5,133,375 | A * | 7/1992 | Schinzing et al. | 134/123 |
| 5,918,617 | A * | 7/1999 | Garth | 137/1 |
| 2008/0087306 | A1* | 4/2008 | Kim | 134/95.2 |
| 2009/0277475 | A1* | 11/2009 | Goddard | 134/10 |

* cited by examiner

*Primary Examiner* — Jason Ko

(57) ABSTRACT

This is a cleaning apparatus that automatically cleans the inside of a hose, end to end, by placing each end of a hose as a male into a female manifold which allows for complete exposure of the entire interior surface of a hose to the cleaning and drying process for the purpose of removing contaminants such as bacteria. A sprayer is fluidly connected to the exhaust manifold via a conduit and configured to spray liquid onto the outside of a hose as well as breathing mask components to be cleaned. A three-way valve is configured to control flow of the liquid, pumped by the pump, and the heated air, blown by the blower, into the intake manifold which provides the means to get the cleaning fluid inside a hose during the cleaning and rinsing cycles and air inside of a hose during the dry cycle.

8 Claims, 3 Drawing Sheets

HOSE CLEANING APPARATUS AND METHOD

REFERENCE TO RELATED APPLICATION

This application claims the benefit of U.S. Provisional Patent Application No. 61/610,420, filed Mar. 13, 2012, entitled "Automatic Washer for Continuous Positive Airway Pressure (CPAP) Machine Hose and Mask."

BACKGROUND OF THE INVENTION

The present invention relates to an automatic washer for Continuous Positive Airway Pressure (CPAP) machine hose and mask.

Continuous Positive Airway Pressure is now the first treatment for obstructive sleep apnea in most people. A machine that is connected to a tight fitting mask with a hose delivers CPAP. The problem is that there is no efficient and easy way of cleaning the hose and mask. As of now it is recommended that one cleans the hose and mask by hand. Washing the CPAP hose and mask by hand involves a lot of effort by the individual and often results in a messy sink area. It also involves a time commitment to adequately wash and rinse in order to kill all of the bacteria. Inadequate hand washing of the hose and mask can result in the hose and mask still containing bacteria.

Most people drape the hose over a door and place the mask pieces on a sink top to dry. A problem arises when placing the hose over a door to dry in that the moisture that evaporates inside the hose has nowhere to go since the ends are hanging down. So the drying process could cause bacteria growth due to the moist environment inside the hose.

Many people tend to sleep in as late as possible, giving them little time to get ready in the morning. Asking them to cut out 15 minutes of their morning time to clean their hose and mask is a major inconvenience. Some may skip the cleaning process altogether, allowing the bacteria to grow and potential create a health hazard. Even if time was taken to clean the hose and mask every morning, it is tough to clean all of the nooks and crannies of the mask and the inside of the hose adequately cleaned when done by hand. It is also tough to get the inside of the hose to dry.

As can be seen, there is a need for solutions to these and other problems.

SUMMARY OF THE INVENTION

In one aspect of the present invention, a cleaning apparatus for a hose comprises: a wash basin comprising an intake manifold, an exhaust manifold, and a basin drain port; a fresh water reservoir connected to the wash basin via a fill valve; a sprayer fluidly connected to the exhaust manifold via a conduit and configured to spray liquid; a pump fluidly connected between the basin drain port and the intake manifold and configured to pump the liquid from the basin drain port to the intake manifold; a drain port fluidly connected to the pump via a drain valve; a blower fluidly connected to the intake manifold via a three-way valve and configured to blow air; an air intake port fluidly connected to the blower; and a controller configured to control the pump, the blower, the fill valve, and the drain valve.

In one aspect, the present invention further comprises a heater fluidly connected between the air intake port and the intake manifold and configured to heat air. In one aspect, the three-way valve is configured to control flow of the liquid, pumped by the pump, and the air, blown by the blower, into the intake manifold. In one aspect, the present invention further comprises a float switch located inside the wash basin and connected to the controller. In one aspect, the present invention further comprises a plurality of stanchions connected to the wash basin and configured to support the hose. In one aspect, the controller further comprises a drying sensor configured to measure a dryness of the hose. In one aspect, the controller further comprises a timing circuit configured to control the pump, the blower, the fill valve, and the drain valve according to predetermined timing.

In one aspect of the present invention, a method of cleaning a hose comprises: providing the cleaning apparatus as described; attaching one end of the hose to the intake manifold; attaching an opposite end of the hose to the exhaust manifold; providing a cleaning solution in the wash basin; providing water in the fresh water reservoir; using the pump to pump fluid from the wash basin into and through the hose via the three-way valve and the intake manifold and through the sprayer via the exhaust manifold; using the pump to pump fluid from the wash basin to the drain port via the drain valve; and using the blower to blow air from the air intake port into and through the hose via the three-way valve. In one aspect, the hose comprises a hose for a human breathing machine. In one aspect, the method further comprises using the cleaning apparatus to clean a mask for the human breathing machine.

These and other features, aspects and advantages of the present invention will become better understood with reference to the following drawings, description and claims.

DETAILED DESCRIPTION OF THE INVENTION

Figure 1:
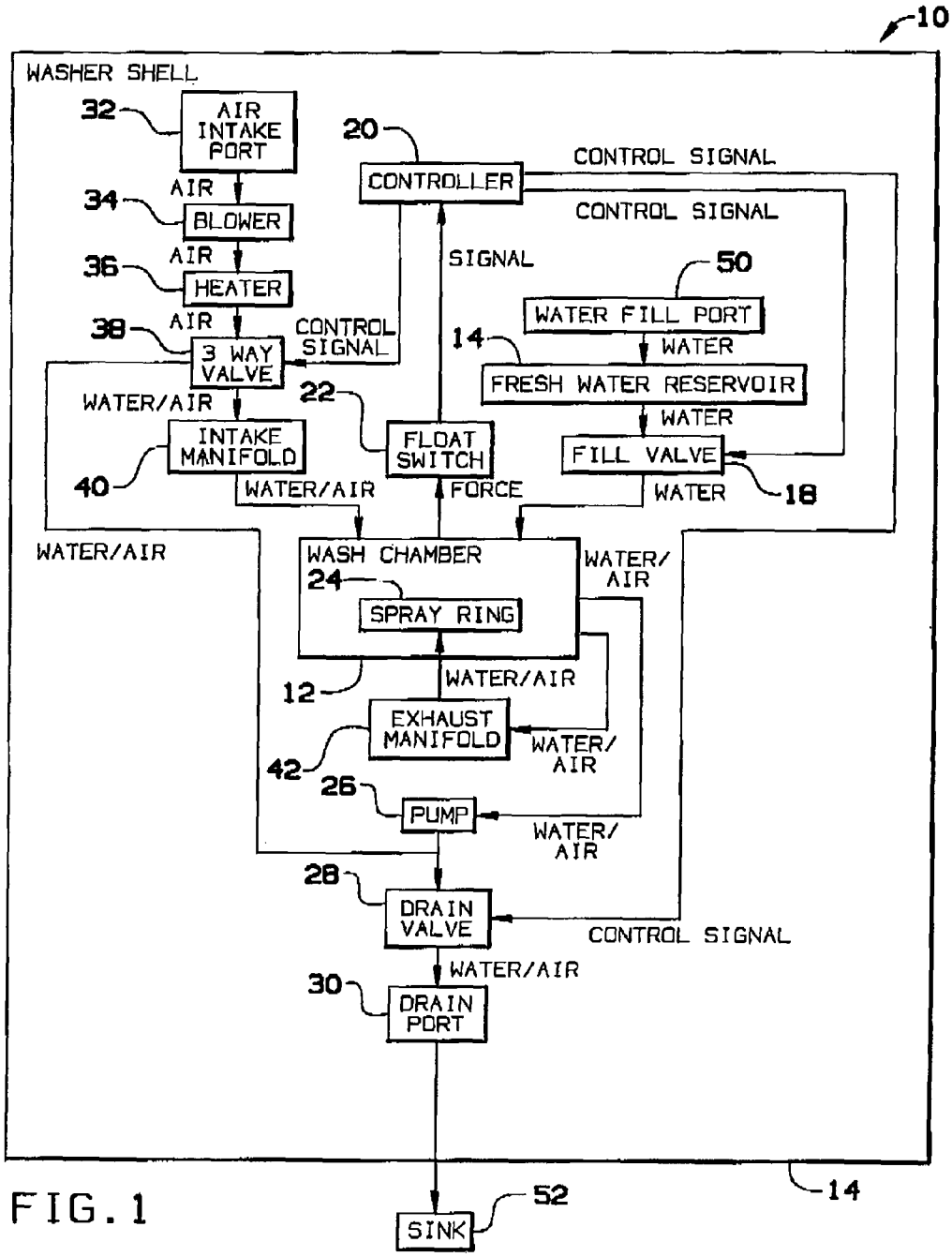
FIG. 1: is a schematic view of one embodiment of the invention.
Figure 2:
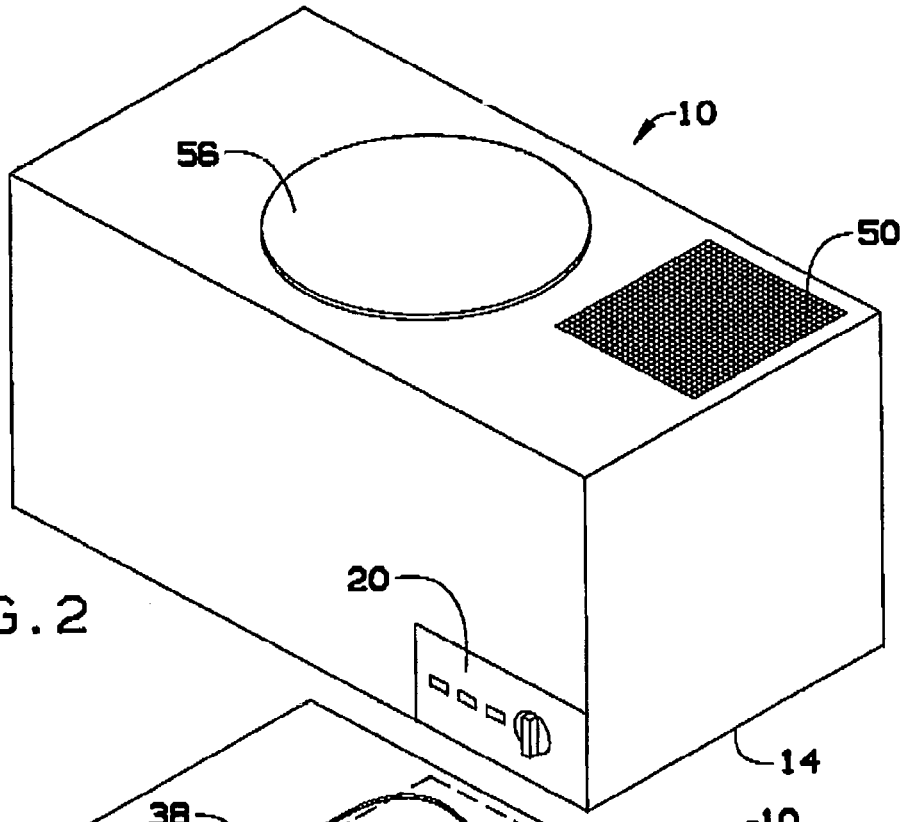
FIG. 2: is a perspective view of one embodiment of the invention.
Figure 3:
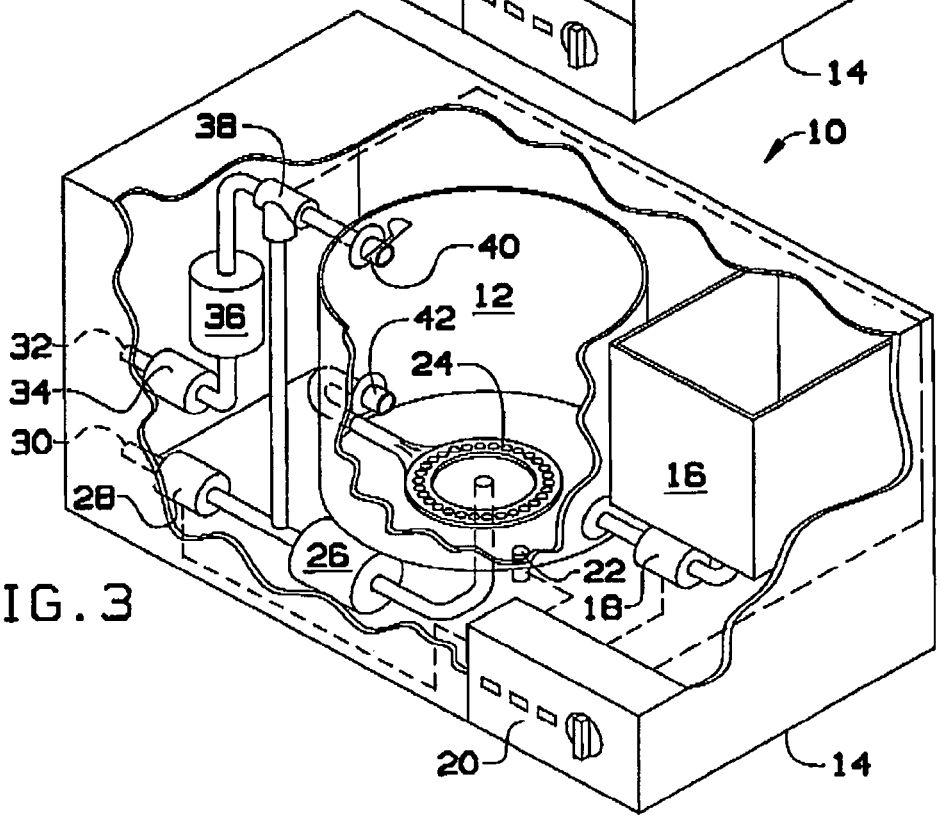
FIG. 3: is a perspective broken view of one embodiment of the invention with stanchion(s) 58, exemplary mask 54 and exemplary hose 48 omitted for illustration.
Figure 4:
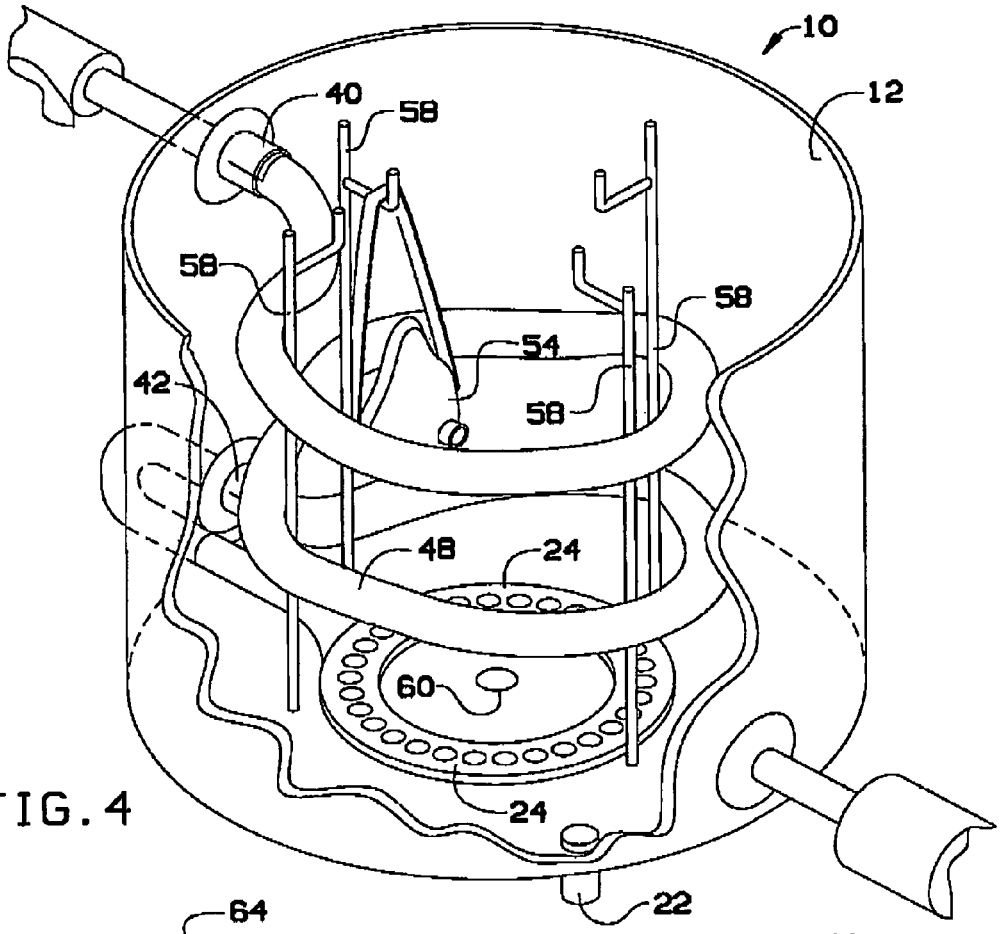
FIG. 4: is a detail broken perspective view of one embodiment of the invention.
Figure 5:
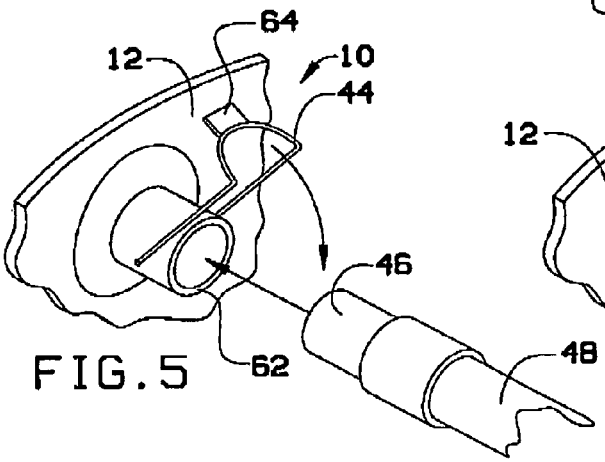
FIG. 5: is a detail perspective view of one embodiment of the invention illustrating pre-insertion of exemplary hose end 46 into general manifold 62.
Figure 6:
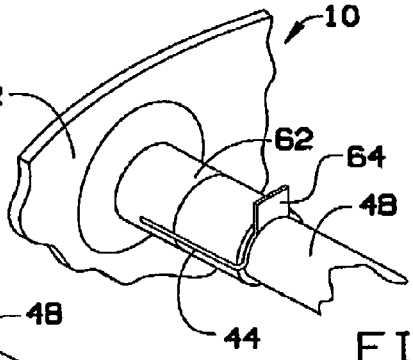
FIG. 6: is a detail perspective view of one embodiment of the invention illustrating post-insertion and locking of exemplary hose end 46 into general manifold 62.

The following detailed description is of the best currently contemplated modes of carrying out exemplary embodiments of the invention. The description is not to be taken in a limiting sense, but is made merely for the purpose of illustrating the general principles of the invention.

Referring now to the figures, the following reference numbers may refer to elements of the invention:

10: is the washer assembly.
12: is the wash chamber/basin.
14: is the washer shell.
16: is the fresh water reservoir.
18: is the fill valve.
20: is the controller.
22: is the float switch.
24: is the sprayer or spray ring.

26: is the pump.
28: is the drain valve.
30: is the drain port.
32: is the air intake port.
34: is the blower.
36: is the heater.
38: is the three-way valve.
40: is the intake manifold.
42: is the exhaust manifold.
44: is the hose clip.
46: is the exemplary hose end.
48: is the exemplary hose.
50: is the water fill port.
52: is the exemplary sink.
54: is the exemplary mask.
56: is the basin lid.
58: is the stanchion.
60: is the basin drain port.
62: is the general manifold.
64: is the hose clip finger tab.

The present invention removes the human element from the washing and drying process and will consistently, efficiently, and effectively clean and dry the hose and mask. Individual time commitment is minimal and the sink area is left as clean as before the process started. With an easy cleaning and drying process, individuals with CPAP may reduce any potential health hazards.

One Version of the Invention Discussed Here Includes:

Washer shell. A plastic container with a lid big enough to fit on a counter top and small enough to contain the washer components.

Wash basin. A round container with lid, smaller than the washer shell. It must be big enough to hold the hose, mask components, and center wash tube and small enough to allow for valves and pump to fit outside of it but inside the above larger container.

Water reservoir. A small container to hold approximately four liters of water.

A pump that will circulate the wash and rinse water.

A controller to control the washer components, capable of turning the pump, fill valve, and drain valve on and off at programmed intervals.

An electrically controlled water fill valve, low pressure (e.g., gravity fed).

An electrically controlled water drain valve.

A float switch.

As needed, tubing to make connections.

As needed, electrical wiring to make connections.

As needed, glue.

As needed, caulking.

As needed, PVC pipe for manifolds.

Stainless steel ¼ inch rod to create stanchions to hold the mask parts and hose.

Stainless steel spring clips that are mounted to the manifolds and will be used to hold the hose in place.

Spray ring. The spray ring has small holes drilled along its length and around its circumference so that a spray of water comes out to wash the mask pieces and outside of the hose.

Piping "T".

Blower.

Electric Heater.

Three-Way diverter valve.

The above list may not be exclusive, nor are all the elements necessary, and the sizes and materials are not limited to those listed.

Relationship Between the Components:

One embodiment of the invention will be described here, although without intention to limit the invention to the specific example described.

The washer shell contains all of the washer components. The wash basin fits in the washer shell and will hold the hose and mask and contain the spray ring and stanchions and contain the wash process. The stanchions are mounted with glue and caulk as needed to the wash basin in a way that will support the coiled hose and hold the mask components when they are put into the washer. The pump will circulate the wash and rinse water and its inlet is connected to the bottom of the washbasin with tubing and its outlet is connected to one end of the piping T. The middle output of the piping T is then connected to one of the inputs to the three-way diverter valve by tubing. The output of the three-way diverter valve is then connected to the upper manifold by tubing. The other side of this upper manifold is inside the wash basin and is open so that the CPAP hose can be inserted.

The manifolds are mounted through the wash basin wall near the top and a second near the bottom of the wash basin. The manifolds are glued and caulked in place and have spring clips mounted on the inside of the wash basin side of the manifolds. The lower manifold is open on the inside of the wash basin where the hose is inserted and the other end is connected to the wash tube by the tubing. The wash tube is mounted through the wash basin bottom and is glued and caulked in place. The other item that is mounted in the wash basin on the bottom is the float switch which is wired to the controller. The water reservoir fits in the washer shell alongside the wash basin for holding the fresh water that is used for the wash and rinse cycles.

Tubing connects through the bottom of the water reservoir to the electrically controlled water fill valve. Tubing then connects the electrically controlled water fill valve to the bottom of the wash basin where it is glued and caulked in place. The water fill valve is wired to the controller. The remaining open end of the piping T is connected to the electrically controlled water drain valve with tubing. The other end of the drain valve exits through the bottom side of the washer shell. The water drain valve is wired to the controller. The blower input is connected to an air inlet on the side of the washer shell with tubing. The output of the blower is connected to the electric heater with tubing. The output of the electric heater is connected to the remaining input of the three-way diverter valve with tubing.

How the Invention Works:

One embodiment of the invention in use or operation will be described here, although without intention to limit the invention to the specific example described.

Place the automatic washer next to a sink so that the drain hose runs into the sink. Open the wash basin lid. Insert one end of the CPAP hose into the lower manifold and then snap the spring clip around the hose. Coil the hose around the stanchions until the other end of the CPAP hose can be inserted into the upper manifold then snap the spring clip around the hose. Place the CPAP mask components on the stanchions in the wash basin. Plug the washer into an AC outlet. Add hot tap water to the washer reservoir until full. Add a quantity (e.g., 5 mL) of the chlorine based dishwasher soap to the washbasin. Close the wash basin lid. Turn on the automatic washer at the controller.

The first cycle of the automatic washer is the wash cycle. The controller activates the water fill valve and water from the reservoir flows to the wash basin and mixes with the detergent. The water level in the wash basin rises until the float switch sends a signal to the fill valve to shut when the appropriate level has been reached. The controller then turns on the pump for the wash cycle. The detergent-laced water circulates from the wash basin through the pump, through the tubing, through the manifold, into the CPAP hose, through the manifold, through the tubing to the spray ring, sprays out the holes in the spray ring, washing the CPAP mask parts and the outside of the CPAP hose, then gathers in the bottom of the washbasin. After five minutes of the wash cycle, the controller opens the drain valve and the wash water is pumped out of the drain tube into the sink. The controller keeps the pump on and the drain valve open for a fixed amount of time that allows for the drain cycle to complete. The controller then turns off the pump and closes the drain valve.

The second cycle of the automatic washer is a rinse cycle. The controller activates the water fill valve and water from the reservoir flows to the wash basin. The water level in the wash basin rises until the float switch sends a signal to the fill valve to shut when the appropriate level has been reached. The controller then turns on the pump for the rinse cycle. The water circulates from the wash basin through the pump, through the tubing, through the manifold, into the CPAP hose, through the manifold, through the tubing to the spray ring, sprays out the holes in the spray ring, washing the CPAP mask parts and the outside of the CPAP hose, then gathers in the bottom of the washbasin. After two minutes of the rinse cycle, the controller opens the drain valve and the rinse water is pumped out of the drain tube into the sink. The controller keeps the pump on and the drain valve open for a fixed amount of time that allows for the drain cycle to complete. The controller then turns off the pump and closes the drain valve.

The third cycle of the automatic washer is another rinse cycle and the process described above in the first rinse cycle repeats. The fourth cycle is a dry cycle. The controller activates the blower, electric heater, three-way diverter valve, and the drain valve. Room air is sucked through the air intake through tubing and into the blower. The air is then blown through the electric heater where it is warmed. The warmed air then circulates through the 3-way diverter valve, through the manifold, into the CPAP hose, through the manifold, to the spray ring, blows out the holes in the spray ring, drying the CPAP mask parts and the outside of the CPAP hose, then flows through the drain in the bottom of the washbasin, through the pump, through the T, through the drain valve, and out the drain port. After 20 minutes of the dry cycle, the controller stops the dry cycle. The controller then turns off the blower, electric heater, three-way diverter valve and closes the drain valve. The wash and dry cycles are complete. When the washer and dryer is finished, open the wash basin lid and remove the CPAP hose and mask.

This invention may use a timer control circuit. The controller opens the fill valve and allows water into the wash chamber until the level is high enough for the float switch to turn it off. The controller then turns on the pump for the wash cycle. After the wash cycle, the controller opens the drain valve until the wash chamber is empty. The controller then cycles the fill valve, pump and drain valve for two rinse cycles. Next the controller puts the device into a dry cycle where it turns on the blower and heater for the programmed time.

The drying element is not necessary for this to be an effective washer. It does however contribute to a thorough and effective cleaning process. An additional element that would improve this invention would be to add a heater that would bring the water temperature up to 160 degrees F. in order to kill bacteria with any detergent. Another element to improve the invention would be to incorporate a removable water reservoir to make it easier to fill it up at a faucet. An element that would improve the automatic washer would be to include adapters to make it functionally capable to accept different size hoses and possibly other respirator medical equipment. Another element that would improve the automatic washer would be to incorporate a drying sensor to automatically sense the dryness of the air to control the length of the drying cycle.

The elements of this automatic washer can be scaled up into a larger permanent automatic washer that would wash a number of CPAP hoses and masks. This larger automatic washer would be useful for hospitals and sleep study centers where many hoses and masks must be washed and sterilized every day, sometimes multiple times a day. One way of scaling up is to add multiple ports to the manifolds and increase the pump capacity to meet the additional flow requirements.

How to Use the Invention:

One embodiment of the invention in use or operation will be described here, although without intention to limit the invention to the specific example described.

Place the automatic washer next to a sink so that the drain hose runs into the sink. Open the wash basin lid. Insert one end of the CPAP hose into the lower manifold and then snap the spring clip around the hose. Coil the hose around the stanchions until the other end of the CPAP hose can be inserted into the upper manifold then snap the spring clip around the hose. Place the CPAP mask components on the stanchions in the wash basin. Add hot tap water to the washer reservoir until full. Add a quantity (e.g., 5 mL) of the chlorine-based dishwasher soap to the washbasin. Close the wash basin lid. Plug the washer into an AC outlet. Turn on the automatic washer at the controller by turning the control knob to the wash position. Allow the automatic washer to complete its wash, rinse, and dry cycles and to turn off. When the washer is finished, open the wash basin lid and remove the CPAP hose and mask. When finished, put the automatic washer away in a safe dry place.

The present invention allows for the ability to clean and dry the inside of a long hose. There are other hoses out there that need cleaning and this invention can be altered to clean them, such as oxygen lines, nebulizer tubes, etc.

In one aspect of the present invention, a cleaning apparatus for a hose 48 comprises: a wash basin 12 comprising an intake manifold 40, an exhaust manifold 42, and a basin drain port 60; a fresh water reservoir 16 connected to the wash basin 12 via a fill valve 18; a sprayer 24 fluidly connected (i.e., connected via one or more conduits configured to carry a flowing fluid) to the exhaust manifold 42 via a conduit and configured to spray liquid; a pump 26 fluidly connected between the basin drain port 60 and the intake manifold 40 and configured to pump the liquid from the basin drain port 60 to the intake manifold 40; a drain port 30 fluidly connected to the pump 26 via a drain valve 28; a blower 34 fluidly connected to the intake manifold 40 via a three-way valve 38 and configured to blow air; an air intake port 32 fluidly connected to the blower 34; and a controller 20 configured to control the pump 26, the blower 34, the fill valve 18, and the drain valve 28.

In one aspect, the present invention further comprises a heater 36 fluidly connected between the air intake port 32 and the intake manifold 40 and configured to heat air. In one aspect, the present invention further comprises a liquid heater (which could, for example, be an element of pump 26) configured to heat the liquid to a temperature in excess of approximately 160 degrees Fahrenheit or other temperatures known to kill bacteria. In one aspect, the three-way valve 38 is configured to control flow of the liquid, pumped by the pump 26, and the air, blown by the blower 34, into the intake manifold 40, such as by allowing only the liquid to flow, or only the air to flow. In one aspect, the present invention further comprises a float switch 22 located inside the wash basin 12 and connected to the controller 20 to give the controller 20 feedback on when the wash basin 12 is sufficiently filled.

In one aspect, the present invention further comprises a plurality of stanchions connected to the wash basin and configured to support the hose. In one aspect, the controller further comprises a drying sensor configured to measure a dryness of the hose. In one aspect, the controller further comprises a timing circuit configured to control the pump, the blower, the fill valve, and the drain valve according to predetermined timing.

In one aspect of the present invention, a method of cleaning a hose comprises: providing the cleaning apparatus as described; attaching one end 46 of the hose 48 to the intake manifold 40; attaching an opposite end of the hose 48 to the exhaust manifold 42; providing a cleaning solution in the wash basin 12; providing water in the fresh water reservoir 16; using the pump 26 to pump fluid from the wash basin 12 into and through the hose 48 via the three-way valve 38 and the intake manifold 40 and through the sprayer 24 via the exhaust manifold 42; using the pump 26 to pump fluid from the wash basin 12 to the drain port 30 via the drain valve 28; and using the blower 34 to blow air from the air intake port 32 into and through the hose 48 via the three-way valve 38. In one aspect, the hose 48 comprises a hose for a human breathing machine. In one aspect, the method further comprises using the cleaning apparatus to clean a mask 54 for the human breathing machine.

It should be understood, of course, that the foregoing relates to exemplary embodiments of the invention and that modifications may be made without departing from the spirit and scope of the invention.

What is claimed is:

1. A cleaning apparatus for a hose that automatically cleans the inside of a hose, end to end, by placing each end of a hose as a male into a female manifold which allows for complete exposure of the entire interior surface of a hose to the cleaning and drying process as well as the exterior of a hose using components that are configured to perform a function in the cleaning and drying of a hose inside and outside which comprise, comprising:

a wash basin comprising an intake manifold, an exhaust manifold, and a basin drain port;

a fresh water reservoir connected to the wash basin via a fill valve;

a sprayer fluidly connected to the exhaust manifold via a conduit and configured to spray liquid;

a pump fluidly connected between the basin drain port and the intake manifold and configured to pump the liquid from the basin drain port to the intake manifold;

a drain port fluidly connected to the pump via a drain valve;

a blower fluidly connected to the intake manifold via a three-way valve and configured to blow air, wherein the three-way valve is configured to control flow of the liquid, pumped by the pump, and the air, blown by the blower, into the intake manifold which provides the means to get the cleaning fluid inside a hose during the cleaning and rinsing cycles and air inside of a hose during the dry cycle, wherein the three-way valve has two positions to allow the supply of two different input mediums, fluid or air, to the intake manifold, wherein in the first position the cleaning and rinse solution pass to the intake manifold during the wash and rinse cycles and in the second position heated air comes from the blower, passes through the three-way valve and on to the intake manifold to provide the heated air needed to dry the inside of a hose;

an air intake port fluidly connected to the blower, a heater fluidly connected between the air intake port and the intake manifold and configured to heat air needed to dry the inside of a hose; and a controller configured to control the pump, the blower, the fill valve, and the drain valve wherein the controller further comprises a drying sensor configured to measure a dryness of a hose to indicate when it reaches a level of dryness necessary to ensure the interior environment of the hose is such that it is not conducive to bacteria growth after the washing cycle completes.

2. The cleaning apparatus as claimed in claim 1, further comprising a liquid heater configured to heat the liquid to a temperature up to approximately 160 degrees Fahrenheit which is the temperature needed to activate the cleaning properties of the detergent in order to clean the bacteria from the inside of a hose.

3. The cleaning apparatus as claimed in claim 1, further comprising a float switch located inside the wash basin and connected to the controller.

4. The cleaning apparatus as claimed in claim 1, further comprising a plurality of stanchions connected to the wash basin and configured to support the hose in such a way to allow for the cleaning, drainage, and drying of the inside of a hose as well as support CPAP mask components for the wash and dry cycles.

5. The cleaning apparatus as claimed in claim 1, wherein the controller further comprises a timing circuit configured to control the pump, the blower, the fill valve, and the drain valve according to predetermined timing.

6. A method of cleaning a hose, comprising:

providing the cleaning apparatus as claimed in claim 1;

attaching one end of the hose to the intake manifold;

attaching an opposite end of the hose to the exhaust manifold;

providing a cleaning solution in the wash basin;

providing water in the fresh water reservoir;

using the pump to pump fluid from the wash basin into and through the hose via the three-way valve and the intake manifold and through the sprayer via the exhaust manifold;

using the pump to pump fluid from the wash basin to the drain port via the drain valve; and using the blower to blow air from the air intake port into and through the hose via the three-way valve.

7. The method as claimed in claim 6, wherein the hose comprises a hose for a human breathing machine.

8. The method as claimed in claim 7, further comprising using the cleaning apparatus to clean a mask for the human breathing machine.

* * * * *